United States Patent [19]

Patin

[11] 3,950,583

[45] Apr. 13, 1976

[54] METHOD OF AND APPARATUS FOR MANUFACTURING A NET OF NON-WOVEN THREADS

[75] Inventor: Claude Patin, Pont Audemer, France

[73] Assignee: Papeteries de Pont-Audemer, Paris, France

[22] Filed: Feb. 25, 1974

[21] Appl. No.: 445,601

[30] Foreign Application Priority Data

Feb. 26, 1973 France ..... 73.07036

[52] U.S. Cl. ..... 428/105; 28/1 CL; 156/172; 156/433; 156/180; 156/439; 156/181; 156/441; 156/229; 428/110; 428/247

[51] Int. Cl.[2] ..... B65H 81/08; B04H 3/08

[58] Field of Search ..... 156/181, 174, 180, 172, 156/178, 168, 177, 254, 166, 427, 296, 433, 305, 437, 426, 441, 229, 494, 439, 441; 161/316.6; 264/103; 28/1 CL, 1 CS, 72 NW; 428/105, 245, 110, 247, 112, 288, 113

[56] References Cited

UNITED STATES PATENTS

| | | | |
|---|---|---|---|
| 2,609,320 | 9/1952 | Modigliani | 156/229 |
| 2,696,243 | 12/1954 | Holland | 156/172 |
| 2,772,993 | 12/1956 | Magnuson | 428/193 |
| 3,360,410 | 12/1967 | Romanin | 156/179 |
| 3,437,539 | 4/1969 | Mesek et al. | 156/254 |
| 3,444,024 | 5/1969 | Hillas | 156/178 |
| 3,649,411 | 3/1972 | Bolles | 28/1 CL |

*Primary Examiner*—William A. Powell
*Assistant Examiner*—J. J. Gallagher
*Attorney, Agent, or Firm*—Ellsworth R. Roston

[57] ABSTRACT

The present invention relates to a method of and apparatus for manufacturing a net of non-woven threads, in which first and second laps of parallel threads, are drawn off, respectively, from a fixed creel and a rotary creel with the first lap longitudinal and the second lap transverse and wound about the first lap. The threads of the second laps are severed at each of two opposed longitudinal edges of the first lap and the net formed by part at least of the longitudinal threads of the first lap and those pieces of the transverse threads of the second lap which are situated on one and the same side of the first lap is collected and stabilized, while there is effected relative running ahead of the longitudinal threads which increases progressively from one thread to the next in relation to one of said edges, from the latter up to the other edge.

14 Claims, 6 Drawing Figures

METHOD OF AND APPARATUS FOR MANUFACTURING A NET OF NON-WOVEN THREADS

This invention relates to the manufacture of nets of non-woven threads, such as those which are used, for example, for making up non-woven textile structures or for reinforcing sheets of paper or of plastics material. These nets are made up of two series of threads, namely one series of longitudinal threads or warp threads, and one series of transverse threads or weft threads, the threads being joined each to the others at the cross-over points in the net, for example by a size or adhesive, or by welding. The threads may be of natural or synthetic textile material, of plastics material, or of mineral material such as glass, or of any other suitable material.

In one of the known methods for the manufacture of nets of non-woven threads, the transverse threads are continuously placed in position by dividing one or several threads transversely from one edge to the other of the lap or package of warp threads in accordance with a reciprocating movement. If the transverse threads are thus constituted starting from a small number of divided threads, it is possible to dispose them in one direction substantially perpendicular to that of the warp threads. However the practical realization of such a method presents considerable difficulties and only a very slow manufacture can be obtained. In another known method, the transverse threaads are constituted from a second lap or package of parallel threads which is wound spirally about the first lap or package constituted by the warp threads. In spite of its advantages, particularly concerning the possibility of continuous manufacture at high speed, this method cannot suit all applications. Its principal disadvantage resides in the fact that it always results in nets with lozenge-shaped meshes whereas nets with rectangular or square meshes are often preferred where the transverse threads are substantially perpendicular to the warp threads, even if this is only for aesthetic reasons.

The object of the present invention is to enable nets of non-woven threads with orthogonal, rectangular or square meshes to be obtained, while retaining the advantages of continuous easy and quick manufacture.

According to the present invention, we provide a method of manufacturing a net of non-woven threads, comprising forming a first lap or package of parallel longitudinal threads, winding a second lap or package of parallel transverse threads spirally about said first lap or package, severing the threads of the second lap or package at two longitudinal edges, and collecting and joining up the net formed by part at least of the longitudinal threads of the first lap or package and those pieces of transverse threads of the second lap or package which are located on one and the same side of said first lap or package, while effecting relative running ahead of the longitudinal threads which increases progressively from one thread to the next in relation to one of said edges, from the latter edge up to the other edge.

The running ahead thus brought about enables the lozenge-shaped mesh produced by wrapping the second lap or package of threads spirally around the first lap or package of threads to be deformed in such a way as to obtain an orthogonal mesh. By simultaneously increasing the mutual spacing apart from one another of the various threads of the first lap or package it is possible to maintain the tension of the transverse threads.

The holding back of the longitudinal threads with respect to one another and the corresponding increase in the spacing apart of the individual threads may be brought about in different ways. According to a preferred manner of carrying out the process which is the object of the invention, there is imposed in all of the longitudinal threads, one and the same angular deviation, simultaneously for all of the longitudinal threads, in accordance with a line parallel to the transverse threads before deviation, and on deviating the longitudinal threads in a direction perpendicular to this line, there is obtained directly a net with orthogonal meshes without modifying the tension of either the longitudinal threads or the transverse threads.

A further object of the invention is to provide apparatus specially constructed for putting into practise the aforesaid method as well as nets of non-woven fibres obtained by this process and articles including such nets.

The invention will be better understood on reading the description which follows, and on examining the accompanying drawings which illustrate, by way of example, one particular embodiment of the method and apparatus constituting the subject of the invention.

Figure 1:
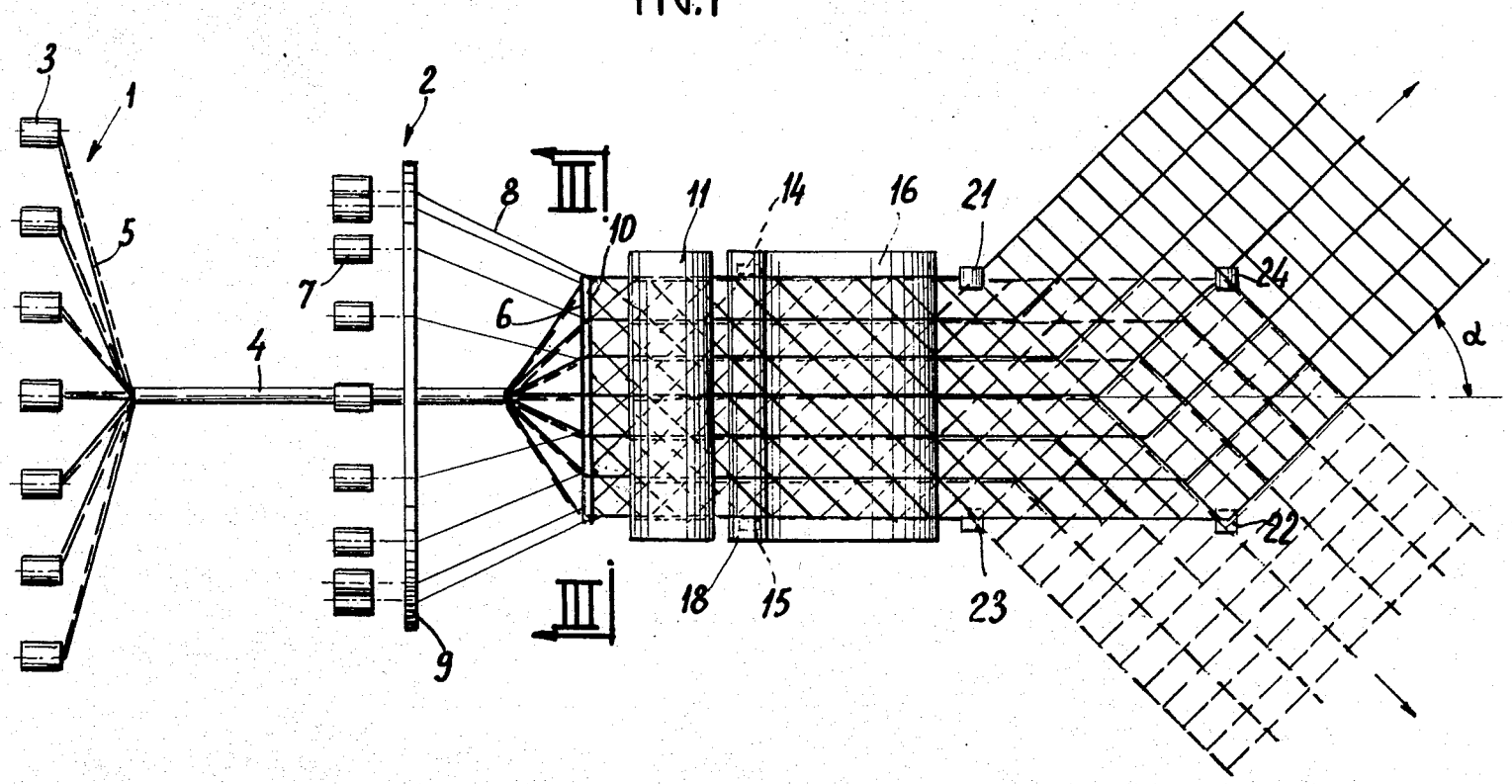
FIG. 1 illustrates diagrammatically apparatus according to the invention and netting in the course of its production in the apparatus.
Figure 2:
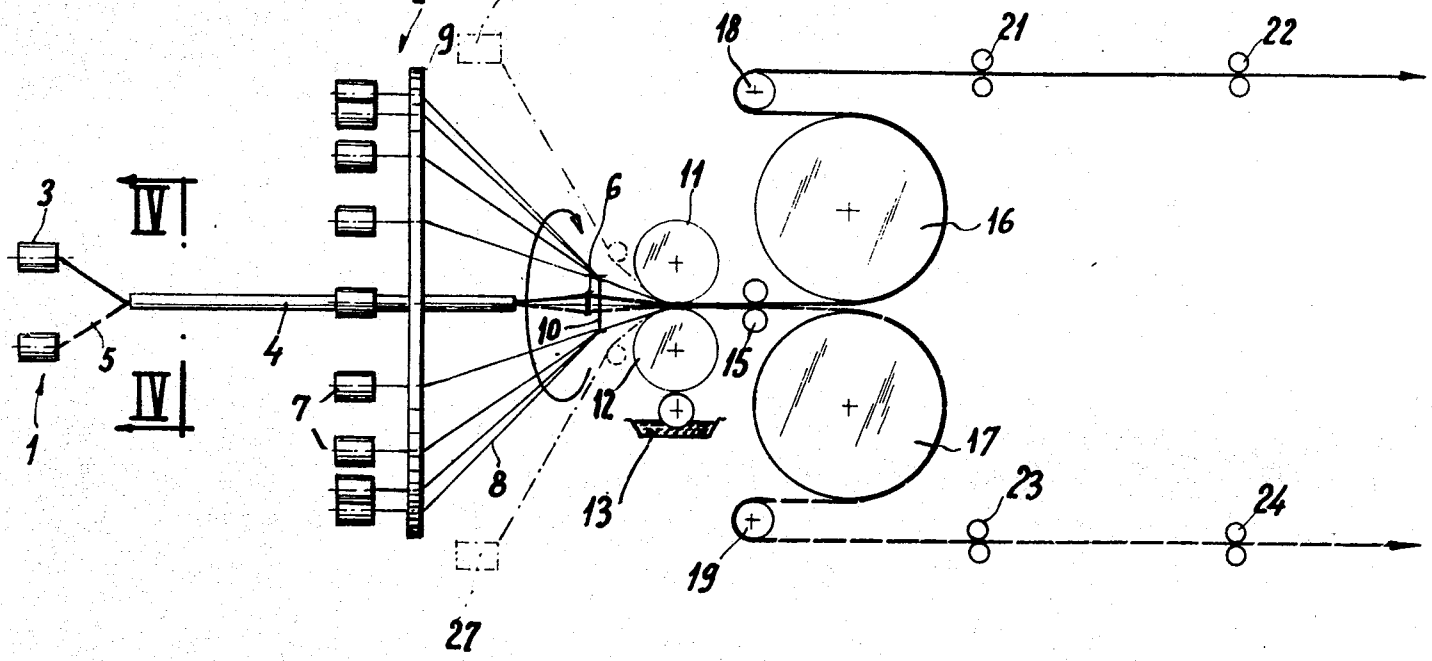
FIG. 2 shows the apparatus in partial longitudinal section.
Figure 3:
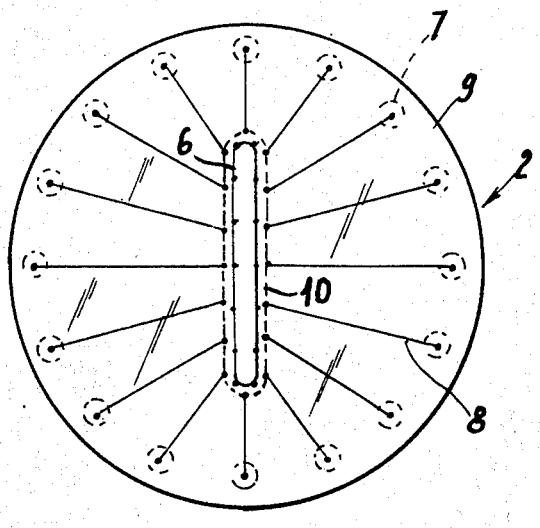
FIG. 3 is a section through the apparatus along the line III–III in FIG. 1.
Figure 4:
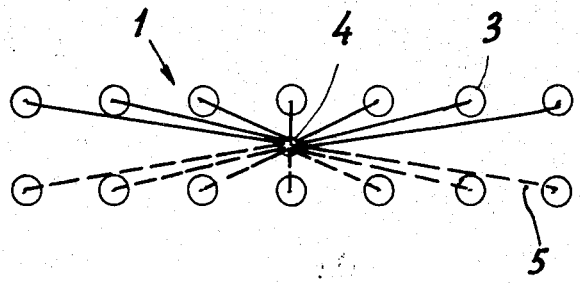
FIG. 4 is a section through the apparatus along the line IV–IV in FIG. 2.

As shown in FIGS. 1 and 2 the apparatus includes a fixed creel 1 and a rotary creel 2. The rells or bobbins 3 of the fixed creel 1 are arranged in two parallel rows as shown in FIG. 4. There is joined to the creel 1 a tube 4 centered on the axis of the apparatus and through which pass threads 5 drawn out from the reels 3. These threads are intended to make up a first lap or package of longitudinal threads, or warp threads. To this end they are drawn off by a comb which distributes them substantially into one plane, or more accurately into two planes slightly separated from one another and parallel to the plane of FIG. 1, the lap in this case being annular.

The rotary creel 2 carries a series of reels 7 regularly spaced apart about the circumference of a circle centered on the axis of the apparatus. From the reels 7 are drawn threads 8 intended to constitute the transverse threads, the threads 8 being drawn in the form of an annular lap or package which in this case is substantially cylindrical and co-axial with the tube 4. The threads reeled off from the rotary creel 2 pass through holes regularly distributed around a circular plate 9 integral with the rotary creel, then through perforated links of a chain 10 which closely surrounds the series of threads passing through the comb 6 and which may be carried along in continuous rotation on said series of threads to make the same number of revolutions per unit of time as the rotary creel 2. The threads of the annular lap are thus wound in flattened spirals around the lap of longitudinal threads as the threads continue to be drawn off from the creels and the chain 10 continues to be rotated.

The apparatus thereafter includes adhesive applying rollers 11 and 12 between which the two laps of threads pass together, flattened into the same plane. Adhesive set apart in a tank 13 in uniformly distributed along the threads. This adhesive remains in a fluid condition until it dries.

After the adhesive applying rollers, the apparatus includes two rotary cutters 24 and 15 disposed at the opposite edges of the lap or package or threads leaving the comb 6. These rotary cutters cut all the transverse threads, immediately to the outside of the outermost warp threads, at each edge.

The apparatus includes, upstream of the adhesive applying rollers, two symmetrical drying rollers 16 and 17, heated, for example, by steam. At this stage the lap of threads is split into two to form two separate nets passing one about each of the drying rollers. One half of the warp threads, regularly spaced apart, passes over the upper drying roller 16; these warp threads carry the pieces of transverse threads which are at the top of the lap, all oblique with respect to the longitudinal threads but parallel to one another. The pieces of transverse threads, inclined in the other sense, which are at the bottom of the lap, are, on the contrary, entrained with the second half of the longitudinal threads which pass over the lower drying roller 17. There are thus obtained, at this stage, two separate nets which have lozenge-shaped meshes, the transverse threads being inclined to the right in one and inclined to the left in the other in accordance with the direction of rotation of the rotary creel.

In a modification, a single net of double width is produced by using a single cutter 14 and by opening and then spreading out the annular lap, thus separating the two longitudinal edges which are merged until reaching the cutter.

According to another modification to another modification, there can be obtained nets in which the transverse threads are engaged between two layers of longitudinal threads, by fitting the apparatus with two additional fixed creels, shown schematically at 26 and 27 in FIG. 2, from which are formed two laps of longitudinal threads which are led between the rollers 11 and 12 one above and one below the laps of threads produced from the creels 1 and 2. This enables avoidance of problems which may be posed by the mobility of the threads when being sized and split into two.

In the embodiment of the invention illustrated in FIGS. 1 to 4, the two laps or packages then pass over rollers 18 and 19 which, although shown as only one for each lap or package, may be more numerous. The laps or packages are then pulled out symmetrically, each perpendicularly to the direction of its transverse threads. The deviation $\alpha$, thus imposed on the warp threads, is selected in terms of the form desired for the meshes of the net and of the initial inclination of the transverse threads. Drawing rollers are arranged at the edges of the lap or package of threads of each net, each set of drawing rollers being on a line parallel to the winding-off rollers (not shown) for the pertaining net. In FIGS, 1 and 2, the drawing rollers 21 and 22 for the upper net, and 23 and 24 for the lower net, are arranged on a line parallel to the transverse threads, so that nets with orthogonal meshes are obtained. The positions of the rollers 22 and 24 may be adjustable.

The deviation of the warp threads, in accordance with the angle $\alpha$, simultaneously causes an increase in their spacing apart from one another, and the transverse threads are left stretched.

In the apparatus which has just been described, the deformation of the nets in order to obtain orthogonal meshes is effected immediately after the formation and putting together of the laps or packages, and before complete drying of the adhesive. Nevertheless, this deformation may just as well be effected differently, for example if there is used for the sizing a size of the "hot melt" type which is caused to set in order to ensure joining of the threads and which is later caused to soften, possibly on another machine, in order to enable the splitting into two and the deformation.

Figure 5:
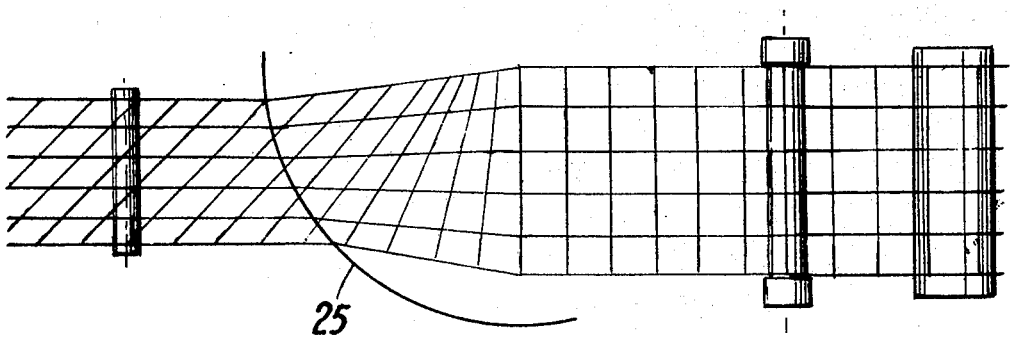
FIG. 5 illustrates diagrammatically a modification of the apparatus.

FIG. 5 illustrates a modification of the apparatus described in which the two nets are drawn or pulled without change in direction, after separation thereof at the drying roller stage. The longitudinal threads are then guided on a hemispherical roller 25 which ensures retardation of the threads some with respect to others, this retardation changing progressively from one edge to the other of the net. The latter is simultaneously subjected to widening which, while increasing the spacing apart from one another of the warp threads, maintains the tension of the transverse threads. The net obtained is finally wound on a drawing roller.

Figure 6:
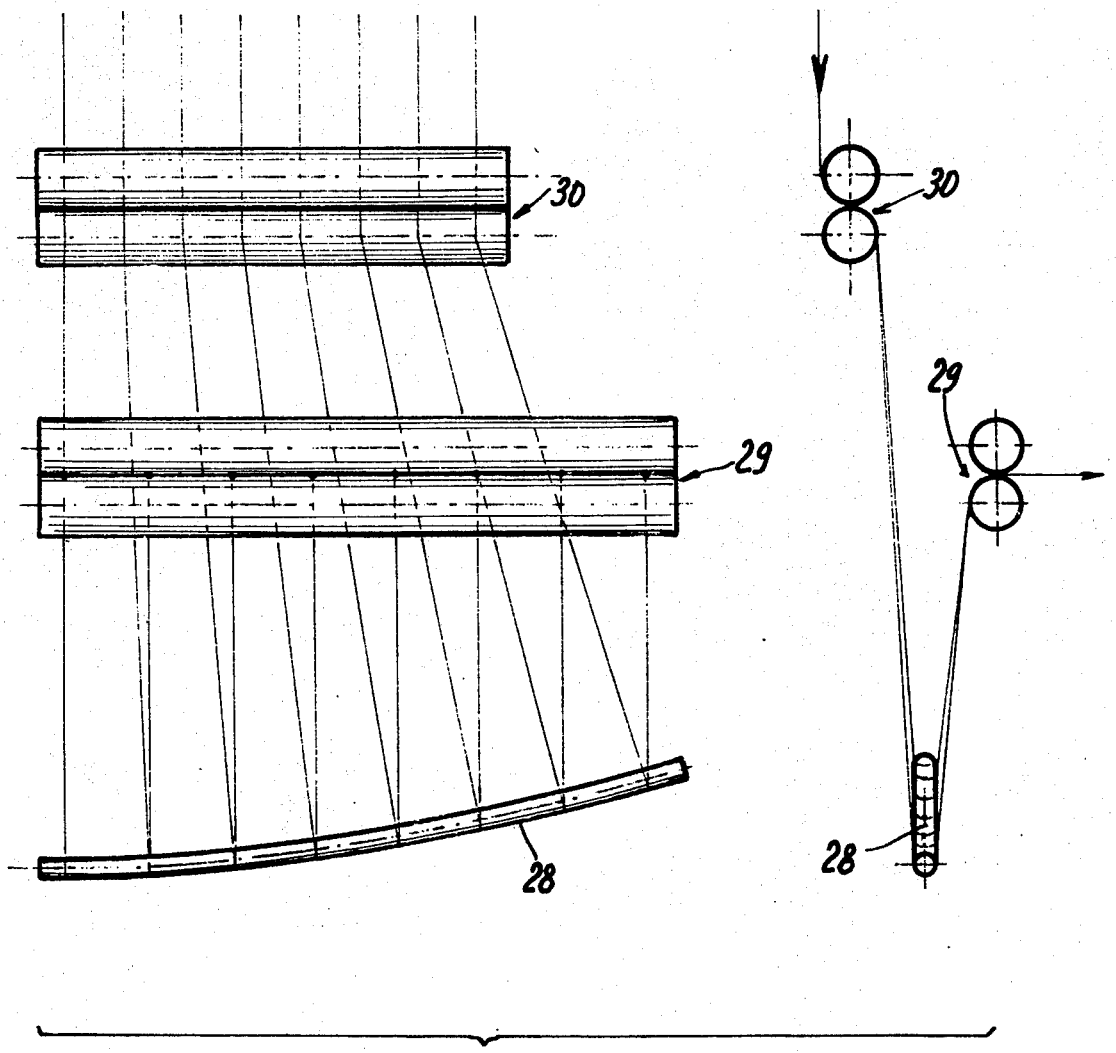
FIG. 6 illustrates another modification of the apparatus.

A further modification is illustrated by FIG. 6.

The apparatus in this case includes, on the path of progress of each of the nets obtained by splitting the laps or packages of the threads, an assembly such as shown, comprising a fixed curved rod or a flexible bowed roller 28, about which the nets are passed, between two pairs of nipping rollers 29 and 30. The distance covered by the longitudinal threads is then of greater or less length according to their positions on passage thereof about the bowed roller, this bringing about the relative retardation ensuring deformation of the meshes, and, simultaneously, the lap or package is widened between the rollers 29 preceding the bowed roller and the rollers 30 which succeed the latter.

In a particular embodiment of the invention, the apparatus according to FIGS. 1 to 4 has been used to manufacture continuously two nets 1 meter wide, each of which has orthogonal meshes in which the threads are spaced apart 1 centimeter in both directions. In the case of an angle $\alpha$ of 30° (in the case shown in the drawings, the angle $\alpha$ is 45°), the warp threads at the outset are spaced apart 88.3 cm. from one another in the widthwise direction. The rotary creel 2 carries 100 reels of weft threads and it makes one complete revolution on the warp threads being advanced one metre. The latter are 204 in number, spaced apart over a width of 88.3 cm. The rotary cutters separate the two threads at the edges of the warp while severing the transverse threads, so that only 101 threads remain for each of the two nets. The latter are spaced apart 86.5 cm. from one another and, after the deviation through the angle $\alpha$, they are spaced over the desired width of 1 metre.

Manifestly, the invention is in no way limited to the example described and shown; it is susceptible of many modifications within the ambit of the skilled worker, in accordance with the applications contemplated, without thereby separating from the scope of the invention.

Thus the fixing of the threads to one another may be effected by any known means other than a adhesive or paste, for example by fusion or ultrasonics for threads of appropriate plastics material.

I claim:

1. The method of manufacturing a net of non-woven threads comprising the steps of forming a first lap of parallel longitudinal threads, winding a second lap of parallel transverse threads spirally about said first lap, severing the threads of the second lap at two longitudinal edges, joining at least part of the longitudinal threads of the first lap and all of those threads of the second lap located on a first side of the first lap, and altering the positions of the threads of the first lap relative to one another in a direction substantially parallel to the threads of the first lap.

2. The method of claim 1 wherein said altering step includes the step of uniformly varying the longitudinal relative positions of the threads of the first lap from one edge of the net thus formed to the other.

3. The method of claim 1 wherein said altering step includes the step of uniformly altering the angular relationship of each transverse thread of the second lap to each longitudinal thread of the first lap.

4. The method of claim 1 wherein said altering step includes the step of moving the longitudinal threads of the first lap, in varying amounts, in a direction substantially perpendicular to the transverse threads of the second lap, thereby changing the configuration of the openings in the mesh formed by the threads of the first and second laps.

5. The method of claim 1 including the steps of joining the remaining longitudinal threads of the first lap and all of those threads of the second lap located on a second side of the first lap, and performing said altering step thereon.

6. A net of non-woven threads formed in accordance with the method of claim 1.

7. An article comprising a net of non-woven threads formed in accordance with the method of claim 1 including sheets of material fixedly attached to and reinforced by said net.

8. The method of forming a net comprising the steps of forming a first lap of parallel longitudinal threads, forming a second lap of parallel transverse threads spirally about said first lap, severing the threads of the second lap at two longitudinal edges of the first lap, joining a portion of the longitudinal threads of the first lap to a portion of the transverse threads of the second lap, thereby forming a mesh of predetermined configuration between each adjacent pair of longitudinal threads and each adjacent pair of transverse threads, and altering the configuration of each mesh thus formed uniformly throughout the net.

9. The method of claim 8 wherein said altering step includes the step of changing each mesh from a lozenge configuration to a rectangular configuration.

10. The method of claim 8 wherein said altering step includes the steps of increasing the spacing between adjacent threads of the first lap while maintaining substantially constant tension in the threads of the second lap.

11. The method of claim 8 wherein said altering step includes the step of moving the longitudinal threads of the first lap, in amounts varying from zero to maximum, in a direction substantially perpendicular to the transverse threads of the second lap.

12. The method of claim 8 wherein said altering step includes the step of moving the longitudinal threads on one longitudinal edge of the first lap at a greater velocity than the longitudinal threads at the other longitudinal edge of the first lap.

13. The method of forming a non-woven net comprising the steps of drawing a first plurality of threads from a first creel, passing the first plurality of threads through a comb, thereby forming them into a first lap of parallel, longitudinal threads, drawing a second plurality of threads from a second creel, winding the second plurality of threads about the first lap in a second lap of parallel, transverse threads, joining threads of the first lap to threads of the second lap, severing the threads of the second lap at at least one location thereon, moving the net thus formed in a direction substantially parallel to the first lap, and increasing the velocity of one edge of the net thus formed relative to the other edge of the net thus formed.

14. The method of claim 13 wherein said moving and increasing steps include the steps of arranging a plurality of drawing rollers along a line substantially parallel to the threads of the second lap and drawing the net through the drawing rollers.

* * * * *